United States Patent [19]

Cerliani

[11] 4,089,282

[45] May 16, 1978

[54] BOBBIN CASE

[75] Inventor: Alberto Cerliani, Pavia, Italy

[73] Assignee: Construzioni Meccaniche Cerliani S.p.A., Pavia, Italy

[21] Appl. No.: 660,376

[22] Filed: Feb. 23, 1976

[30] Foreign Application Priority Data

Nov. 20, 1975 Italy ..... 29490 A/75

[51] Int. Cl.[2] ..... D05B 57/14; B65H 59/04

[52] U.S. Cl. ..... 112/229; 242/156

[58] Field of Search ..... 242/156; 112/228, 229, 112/231; 74/527, 531; 188/67

[56] References Cited

U.S. PATENT DOCUMENTS

| | | | |
|---|---|---|---|
| 2,555,658 | 6/1951 | Ritter | 112/229 |
| 3,902,575 | 9/1975 | Nelson et al. | 74/531 X |

*Primary Examiner*—Stanley N. Gilreath

*Attorney, Agent, or Firm*—Norman S. Blodgett; Gerry A. Blodgett

[57] ABSTRACT

A bobbin case for sewing machines, in which a thin plate spring operates on the bobbin for inhibiting rotation thereof wherein an adjustable screw acts upon the spring to regulate the pressure on the bobbin and means is provided for exerting a constant thrust on the adjusting screw in a direction at a right angle to its axis for preventing it from loosening.

7 Claims, 7 Drawing Figures

BOBBIN CASE

BACKGROUND OF THE INVENTION

As is well known, bobbin cases are commercially available, on the bottom of which a shaped resilient or spring-like thin plate is fastened, this thin plate forming a braking spring which is effective to prevent an undue feed or advancement of the bobbin under the thread traction, which would otherwise cause a breakage in the thread. Depending on the thread being used, the pressure of such a braking spring has to be suitably regulated by the action of an adjusting screw running in a threaded hole in the bobbin case with one of the ends of this screw pressing perpendicularly against the braking spring. However, it is known that the bobbin cases are alternately subjected to vibrations at each of the thread passages. Due to these stresses, the pressure spring adjusting screw in the threaded hole of the bobbin case is urged to a great extent, so that the position of said screw is varied with the different stitching speeds. Accordingly, the pressure on the bobbin braking spring, which consists of a resilient thin plate secured at one of its ends to the bobbin case, will vary as a function of the above-mentioned factors and, therefore, new adjustments are repeatedly required. Additionally, such drawbacks in the bobbin as those causing the lower thread to "jump" beyond the bobbin flange are not avoided, and as a result, a breakage in the thread takes place.

It is an object of the present invention to provide a bobbin case of the above-mentioned design, wherein the adjusting screw for the bobbin braking spring is prevented from loosening or generally changing its position during the operation of the sewing machine.

This object is accomplished by using means for exerting a pressure on the adjusting screw of the braking spring which is perpendicular to the axis of the screw, so that an even, constant loading can be imparted. Thus, following regulation of the pressure on the bobbin braking spring by means of said adjusting screw, the latter invariably maintains its position, so that the braking spring presses evenly on the bobbin.

Accordingly to a particular embodiment of the invention, it is contemplated that a thrust means be used which substantially comprises a plunger urged by a spring against said adjusting screw. Preferably, such a spring may be the spring normally used for the return of the bobbin case latch; therefore, the said thrust means performs a dual function, i.e., it acts as an abutting element for the latch spring and operates as a means for exerting a clamping pressure on the adjusting screw.

The thrust means may be made from any suitable material whose hardness is not unduly high, such as (plastic) synthetic material, or metal material having substantially similar characteristics.

The hole or bore for the spring and the associated thrust means is generally formed at an offset position relative to the axis of the adjusting screw, thus forming a side shoulder limiting the forward stroke of the thrust means; accordingly, the threaded hole is not obstructed and the adjusting screw can be easily and freely removed and threaded inwardly again.

According to another embodiment of the invention, the thrust means may be formed as a leaf spring which is inserted into a side housing opening to the threaded hole for the adjusting screw, and the leaf spring is suitably shaped to press laterally and perpendicular to the axis of the screw.

BRIEF DESCRIPTION OF THE DRAWINGS

Some embodiments of a bobbin case incorporating the improvements according to the invention will now be hereinafter described with reference to the accompanying drawings, in which.

DESCRIPTION OF THE PREFERRED EMBODIMENT

Figure 1:
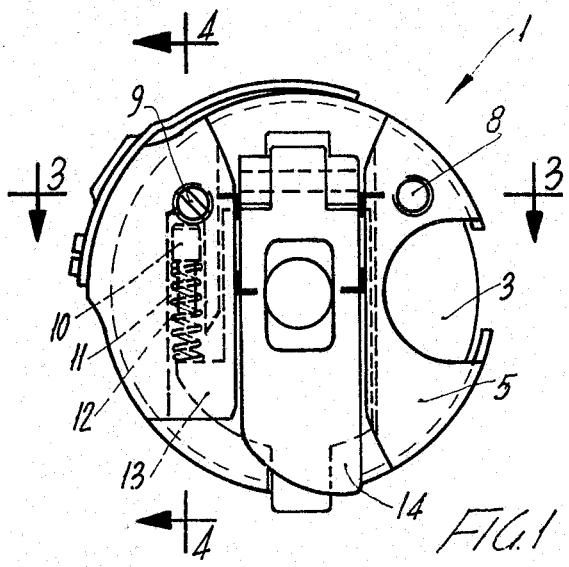
FIG. 1 is a top plan view of a bobbin case incorporating a first embodiment of the invention.
Figure 4:
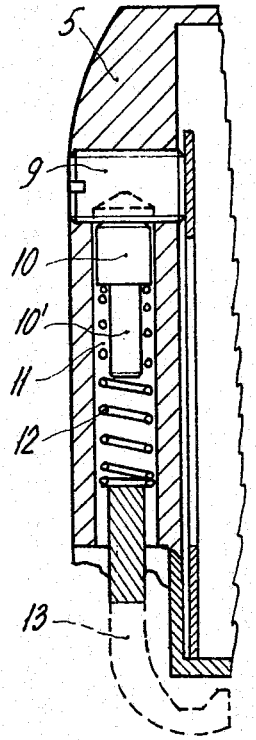
FIG. 4 is an enlarged fragmentary sectional view substantially taken along line 4—4 of FIG. 1.
Figure 2:
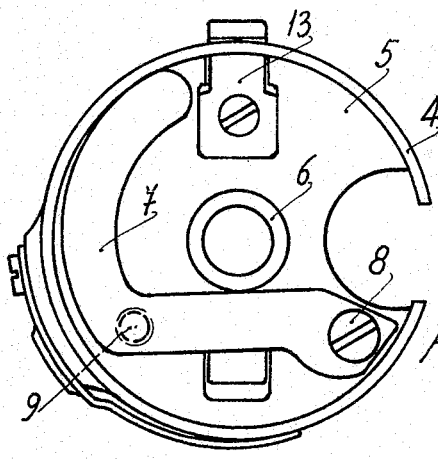
FIG. 2 is a bottom plan view of the bobbin case shown in FIG. 1.
Figure 3:
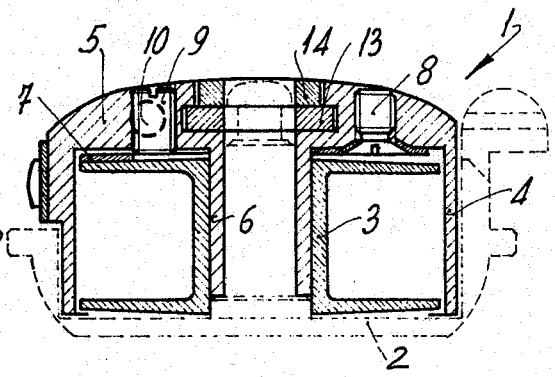
FIG. 3 is a cross-sectional view taken along broken lines 3—3 of FIG. 1.

In FIGS. 1, 2 and 3 of the accompanying drawings, a general type of bobbin case 1 is shown for use in a double knotted-stitch sewing machine which, together with a basket 2 (shown in FIG. 3) for a rotary hook, contains in a known manner a bobbin for the lower stitching thread. The bobbin case 1 has a substantially cylindrical side wall 4 and a bottom wall 5, from which projects a hollow hub 6 carrying a bobbin 3.

As shown in FIGS. 2 and 3 of the accompanying drawings, the bobbin case 1 internally has a resilient thin plate forming a braking spring 7 for the bobbin 3. The bobbin braking spring 7 is suitably shaped and is secured by one of its ends to the bottom of the inner wall 5 of the bobbin case, for example by means of a screw 8; at its other end, the spring 7 acts against the inner flange of the bobbin 3 to urge the latter against the basket 2 and to brake the rotation thereof.

The pressure that the bobbin braking spring 7 can exert on bobbin 3 is adjustable in a known manner by an adjusting screw 9 entering the outside of the bobbin case in a threaded hole provided in the bottom wall 5 of the bobbin case at a position which is intermediate and at a right angle to the braking spring 7.

However, as has been mentioned above, during operation of a sewing machine the bobbin case 1 is subjected to vibrations that cause the adjusting screw 9 to loosen and cause a reduced braking force of the spring 7 on the bobbin 3. Therefore, according to the invention, means has been provided for exerting a pressure on the adjusting screw in a direction perpendicular to its axis, such means preventing the loosening of the screw 9 under vibration, thereby allowing an even, constant loading of the bobbin braking spring.

According to the preferred embodiment shown in FIGS. 1 to 5 of the accompanying drawings, such a thrust or pressure device for the adjusting screw comprises a plunger 10, formed of plastic material, sliding in the longitudinal direction and at the bottom of a hole 11 receiving a return spring 12 for the bobbin case latch 13 and operable through the intermediary of a gripping lever 14.

The said hole 11 has been extended at its bottom to meet the threaded hole for the screw 9. Accordingly, the same latch return spring 12 is used for urging the said plunger 10 against the adjusting screw 9; as a result, this thrust plunger 10 performs the dual function of an abutting element for the latch spring 12 and of means for exerting a pressure or thrust on the adjusting screw 9, as mentioned above.

Generally, the plunger 10 is provided with a rear stem 10' inserting into the spring 12 and it may be of a larger diameter than that of screw 9. However, in case said adjusting screw 9 has to be loosened and removed, in order to prevent the plunger 10 from completely obstructing the threaded hole, it has been provided with a stop shoulder 15 to locate the adjusting screw 9 at an offset position relative to hole 11 of the plunger 10; thus, as shown in the enlarged sectional view of FIG. 5, the stop shoulder 15 is formed for the plunger 10, thus preventing the latter from entering and completely obstructing the hole for the screw 9.

From the foregoing description and as shown in FIGS. 1 to 4, it is apparent that by use of a screwdriver or other implement on the adjusting screw 9, a variation can be brought about of the pressure exerted by the braking spring 7 on the bobbin 3, the rotation of which is accordingly inhibited during the stretching operation. However, the adjusting screw 9 cannot become loose, since an even, constant pressure is exerted thereon by the said plunger 10, thus automatically clamping it and avoiding any unscrewing thereof. When the pressure of the braking spring 7 must be varied, it will suffice to operate the adjusting screw 9, by running the screw forwardly or rearwardly, depending on requirements, thereby assuring that the screw will always maintain its position.

Figure 6:
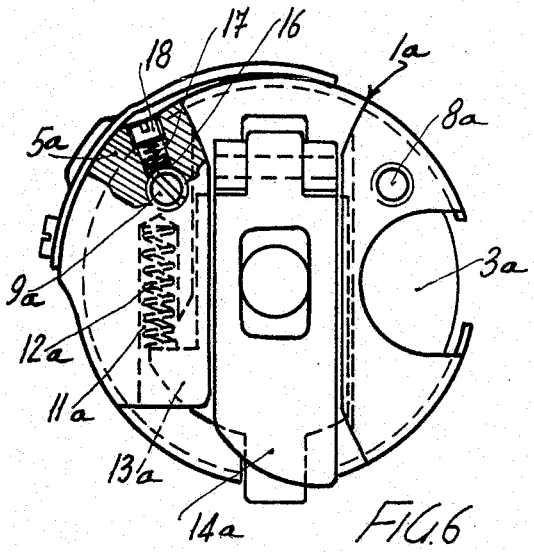
FIG. 6 is a view showing a first modified embodiment of the invention.
Figure 5:
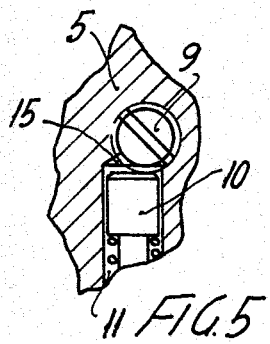
FIG. 5 is an enlarged fragmentary sectional view of the thrust means and adjusting screw for the bobbin braking spring taken in a plane at a right angle to the plane of FIG. 4.

Of course, the thrust device for the adjusting screw 9 is capable of other solutions and arrangements. A first such modification or variant is shown in FIG. 6, in which the thrust device comprises a cup 16 fitted with a thrust spring 17 of its own, independently of the latch return spring 12*a*. The spring 17 is retained by a screw 18 which is laterally screwing from the outside into a hole still located at a right angle to the axis of the adjusting screw 9*a*. In this case said screw 9*a* also can be offset relative to the cup 16 to prevent the latter from obstructing the hole. The bobbin case 1*a*, the bobbin 3*a*, the wall 5*a*, the screw 8*a*, the adjusting screw 9*a*, the hole 11*a*, the spring 12*a*, the latch 13*a*, and the lever 14*a* are similar to the corresponding elements in FIG. 1.

Figure 7:
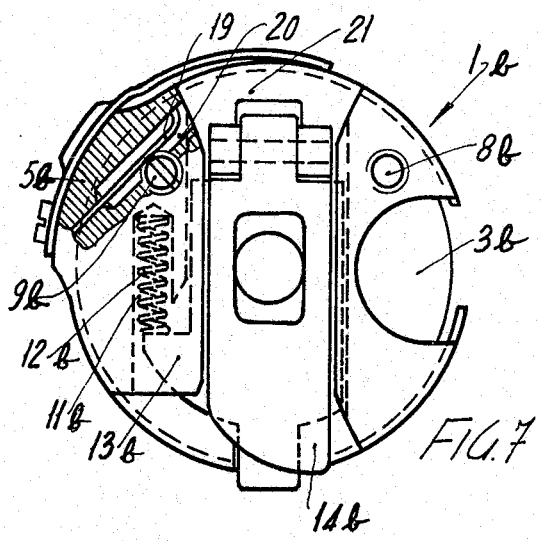
FIG. 7 is a view showing a further modified embodiment of the invention.

A further embodiment of the invention is shown in FIG. 7, in which the parts or elements which are substantially similar to those shown in FIG. 6 and have been designated by similar reference numerals. The bobbin case 1*b*, the bobbin 3*b*, the wall 5*b*, the screw 8*b*, the adjusting screw 9*b*, the hole 11*b*, the spring 12*b*, the latch 13*b*, and the lever 14*b* are similar to the corresponding elements in FIG. 1. In the embodiment of FIG. 7, the thrust device substantially comprises a thin plate spring 19 arranged at a right angle to the axis of screw 9*b* within a guide hole 20 opening with one of its ends into the aperture 21 rearwardly of the latch. This thin plate spring 19 is suitably formed and shaped to constantly press against screw 9*b* and is secured at its inner end by a force fit within a housing in the bottom of hole 20.

Of course, other solutions are possible over those herein shown and described, without departing from this form the principle of the present invention.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A bobbin case for double knotted-stitch sewing machines, comprising a bobbin case latch, a thin plate spring for braking the bobbin, the pressure of which spring is adjustable by means of an adjusting screw operating in a threaded hole provided in the said bobbin case and extending in a direction perpendicular to said braking spring, wherein a means is provided for exerting a thrust on the adjusting screw and allowing an even, constant loading of the latter, the said thrust means comprising a pressure element resiliently urged in a direction at a right angle to the longitudinal axis of the adjusting screw, the said pressure element comprising a plunger urged by a thrust spring and sliding within a guide hole communicating with the threaded hole of the adjusting screw, the said thrust spring also serving as a return spring for the bobbin case latch.

2. A bobbin case according to claim 1, wherein the axis for the adjusting screw of the braking spring is offset relative to the axis of the guide hole for the plunger.

3. A bobbin case according to claim 1, wherein on the bottom of the guide hole of the thrust device a side shoulder is provided for limiting the stroke of the said plunger.

4. A bobbin case according to claim 1, wherein said thrust means is placed within an independent hole provided laterally of and rearwardly of the bobbin case latch.

5. A bobbin case according to claim 1, wherein said thrust means is a thin leaf spring inserted into a hole which is lateral of and at a right angle to the adjusting screw.

6. A bobbin case according to claim 5, wherein said hole has one of its ends opening outwardly at the rear aperture of the bobbin case latch.

7. A bobbin case for double knotted-stitch sewing machines, comprising a bobbin case latch, a thin plate spring for braking the bobbin, the pressure of which spring is adjustable by means of an adjusting screw operating in a threaded hole provided in the said bobbin case and extending in a direction perpendicular to said braking spring, wherein means is provided for exerting a thrust on the adjusting screw, and allowing an even, constant loading of the latter, the said thrust means comprising a pressure element resiliently urged in a direction at a right angle to the longitudinal axis of the adjusting screw, the said pressure element comprising a plunger urged by a thrust spring and sliding within a guide hole communicating with the threaded hole of the adjusting screw, the axis for the adjusting screw of the braking spring being offset relative to the axis of the guide hole for the plunger, the bottom of the guide hole of the plunger being provided with a side shoulder for limiting the stroke of the said plunger.

* * * * *